US011096453B2

(12) United States Patent
Shabot et al.

(10) Patent No.: US 11,096,453 B2
(45) Date of Patent: Aug. 24, 2021

(54) REVERSIBLE BELT STRAP AND BUCKLE

(71) Applicants: David Shabot, Edison, NJ (US); Moshe Sivan, Edison, NJ (US)

(72) Inventors: David Shabot, Edison, NJ (US); Moshe Sivan, Edison, NJ (US)

( * ) Notice: Subject to any disclaimer, the term of this patent is extended or adjusted under 35 U.S.C. 154(b) by 33 days.

(21) Appl. No.: 16/730,173

(22) Filed: Dec. 30, 2019

(65) Prior Publication Data

US 2020/0128923 A1 Apr. 30, 2020

Related U.S. Application Data

(63) Continuation-in-part of application No. 15/903,578, filed on Feb. 23, 2018, now abandoned.

(51) Int. Cl.

| | |
|---|---|
| ***A44B 11/24*** | (2006.01) |
| ***A44B 11/20*** | (2006.01) |
| *A41F 9/00* | (2006.01) |

(52) U.S. Cl.

CPC ..... *A44B 11/20* (2013.01)

(58) Field of Classification Search

CPC ..... A44B 11/20; A44B 11/22; A44B 11/24; A44B 11/26; A44B 11/00; A44B 11/006; A44B 11/12; A44B 11/2515; A44B 11/2561; A44B 17/0023; A44B 17/0029; A44B 17/0041; A44B 17/0058; A44B 11/06; A41F 1/008; A41F 9/002; A41F 1/00; A41F 9/00; A41F 9/025

See application file for complete search history.

(56) References Cited

U.S. PATENT DOCUMENTS

| | | | | |
|---|---|---|---|---|
| 809,465 | A * | 1/1906 | Roy et al. | A44B 11/00 24/593.11 |
| 1,910,891 | A * | 5/1933 | Freysinger | A41F 1/008 24/593.11 |
| 1,910,892 | A * | 5/1933 | Freysinger | A41F 1/008 24/593.1 |
| 4,577,375 | A * | 3/1986 | Beaussant | A62B 18/084 128/201.23 |
| 4,676,535 | A * | 6/1987 | Mautner | B65D 63/1081 24/16 PB |
| 5,588,186 | A * | 12/1996 | Ko | A44B 11/14 24/170 |
| 6,606,770 | B1 * | 8/2003 | Badrenas Buscart | A44B 11/2511 24/625 |
| 7,559,123 | B1 * | 7/2009 | Yang | A44B 11/266 24/316 |
| 7,950,072 | B1 * | 5/2011 | Hanson | A41F 9/002 2/338 |
| 9,155,359 | B1 * | 10/2015 | Bailey | A44B 11/065 |
| 9,392,846 | B2 * | 7/2016 | Shirai | A44B 11/24 |
| 9,930,935 | B2 * | 4/2018 | King | A44B 11/006 |
| 10,182,934 | B2 * | 1/2019 | Hopman | A61F 5/0193 |
| 10,238,161 | B1 * | 3/2019 | Ong | A42B 7/00 |
| 10,238,185 | B1 * | 3/2019 | Ong | A44B 17/0023 |

(Continued)

*Primary Examiner* — Robert H Muromoto, Jr.
(74) *Attorney, Agent, or Firm* — Ezra Sutton

(57) ABSTRACT

A reversible belt having an elongated strap having top and bottom surfaces, and two rows of notches on the top surface of the strap, and two rows of notches on the bottom surface of the strap. The buckle having teeth for engaging the rows of notches on the top surface of the strap, and for engaging the rows of notches on the bottom surface of the strap, when the strap is reversed.

6 Claims, 13 Drawing Sheets

(56) References Cited

U.S. PATENT DOCUMENTS

| | | | | |
|---|---|---|---|---|
| 2006/0053600 | A1* | 3/2006 | Liu | A44B 11/266 24/615 |
| 2006/0174459 | A1* | 8/2006 | Bledsoe | A41F 1/008 24/634 |
| 2007/0180599 | A1* | 8/2007 | Baek | A61N 5/06 2/338 |
| 2007/0220719 | A1* | 9/2007 | Shen | A44B 11/26 24/652 |
| 2009/0178253 | A1* | 7/2009 | Yang | A44B 11/266 24/625 |
| 2010/0011542 | A1* | 1/2010 | Badrenas Buscart | A44B 11/266 24/163 R |
| 2010/0175232 | A1* | 7/2010 | Shirai | A41F 1/008 24/641 |
| 2011/0000057 | A1* | 1/2011 | Abdul | A43C 11/146 24/68 SK |
| 2012/0233743 | A1* | 9/2012 | Park | A41F 9/00 2/237 |
| 2013/0224667 | A1* | 8/2013 | Roybal | F23Q 1/06 431/6 |
| 2014/0155797 | A1* | 6/2014 | Hopman | A61F 5/0102 602/19 |
| 2015/0321813 | A1* | 11/2015 | Iannello | B65D 63/1063 24/3.1 |
| 2016/0135630 | A1* | 5/2016 | Laatz | A44B 11/125 248/317 |

* cited by examiner

REVERSIBLE BELT STRAP AND BUCKLE

This application is a continuation-in-part of application Ser. No. 15/903,578 filed on Feb. 23, 2018, and the priority of this prior patent application is hereby claimed.

FIELD OF THE INVENTION

The present invention relates to a novel reversible belt strap having two rows of notches on each of the top and bottom surfaces of the belt strap, and a belt buckle having teeth for engaging the rows of notches.

BACKGROUND OF THE INVENTION

Presently, there are belts that have teeth for adjusting the size of the belt. However, such belts have a track of notches in the middle of the belt strap, and these belts are not reversible, such that the user cannot simply reverse the belt and use the other side. However, the belt of the present invention has a track of notches on the top and bottom surfaces of the belt, which permits users to simply reverse the belt and use the other side.

DESCRIPTION OF THE PRIOR ART

U.S. Patent Application Publication No. 20160309853 to Liam D. Snyder entitled "Adjustable Belt With Gear System" published on Oct. 27, 2016, and discloses an adjustable belt for wearing around a user's waist is disclosed, as shown below in FIGS. 2, 5, 6 and 7. The belt comprises a strap for placement around the user's waist. A buckle is coupled to a first end of the strap and is configured for accepting a second end of the strap and adjusting a length of the strap. The buckle further comprises a plurality of gears that mate with gear teeth located on an outward facing surface of the strap, such that movement of the second end of the strap within the buckle moves the plurality of gears; a spring loaded ratchet that contacts the gear teeth of the plurality of gears, such that the ratchet only allows movement of the plurality of gears in one direction; and a lever coupled to the spring loaded ratchet, such that activating the lever allows for movement of the plurality of gears in both directions. This belt is not reversible.

U.S. Pat. No. 6,108,821 to Jacques Malsoute entitled "Trouser Belt With Extensible Clasp" issued on Aug. 29, 2000, and discloses a box or clasping part 1 that can be permanently fixed at one extremity of the belt S, as shown below in FIGS. 1, 2, and 3. The clasping part 1 features a back face 2 within which is embossed a lodging 3, designed to accommodate the belt S. Screws or fixing rivets, symbolized by the dotted line 4 of FIG. 4, in lodging 3 ensures the anchoring of the belt extremity S in lodging 3. Furthermore, the clasping part 1 is equipped with a belt loop 6, on its upper face 5, for the opposite extremity of the belt loop.

Also, a buckle 7 with a pin 12, which is used to attach the opposite extremity (not depicted) of the belt S, is mounted on the clasping part 1, in regard of a forward face 8 opposite to the back face 2, so as to slide following the belt clasping direction C or the longitudinal direction corresponding to the longitudinal direction of the loop S. The buckle 7 includes a U-shaped ring 9, mounted on its open side on a transversal bar 10, to which it is articulated around a transversal axis 11. A buckle pin 12, perpendicular to the axis 11, is placed in the middle of the loop 9 whilst articulated to the transversal bar 10 around the axis 11 so as to penetrate one of the perforations of the corresponding extremity of belt S. This belt is not reversible.

PCT Patent Application Publication No. WO1986001983 to Hans Haseli entitled "Fastener for Connecting the Two Ends of a Belt" published on Apr. 10, 1986, and discloses (as shown below in FIGS. 1 and 2) a fastener for connecting the two ends (2, 20) of a belt, in which each of the two ends (2, 20) of the belt is or can be connected with a fastening element (1, 16) of the fastener. The two elements (1, 16) can be moved in opposite directions to each other in the longitudinal direction of the belt over a given length and are capable of being locked in a selectable relative position of the two fastening elements (1, 16). A fastening element (1) possesses a toothed bar (3) which extends along the longitudinal direction of the belt, in the notches (4) of which a tooth (9), arranged on the second fastening element (16), can be engaged under the effect of a pre-loaded spring. This belt is not reversible.

U.S. Pat. No. 9,155,359 to Dennis M. Bailey entitled "Ratchet Buckle With Locking Mechanism" issued on Oct. 13, 2015, and discloses a ratchet buckle system including an elongate adjustment strap having a plurality of inclined teeth transverse to a length of the strap. A ratchet mechanism is provided for engaging the teeth of the adjustment strap. The ratchet mechanism has a lever having a first end for actuating the ratchet mechanism and a distal end having an adjustment pawl for selectively engaging the teeth of the adjustment strap. The lever is pivotally mounted on a first axis transverse to the adjustment strap. A release mechanism having a release button lever is recessed in an opening in the first end of the lever and a locking pawl distal from the release button adjacent the adjustment pawl of the lever. The release button lever is pivotally mounted on a second axis transverse to the adjustment strap for locking engagement of the locking pawl and teeth of the adjustment strap. This belt is not reversible.

OBJECTS OF THE INVENTION

It is an object of the present invention to provide a reversible belt strap that has notches on the surfaces of the strap to adjust the belt.

It is an object of the present invention to provide a buckle for adjustably engaging notches on the surfaces of the strap.

It is another object of the present invention to provide a reversible belt having the above features.

SUMMARY OF THE INVENTION

A reversible belt having an elongated strap having top and bottom surfaces, and two rows of notches on the top surface of the strap, and two rows of notches on the bottom surface of the strap. The buckle having teeth for engaging the rows of notches on the top surface of the strap, and for engaging the rows of notches on the bottom surface of the strap, when the strap is reversed.

DETAILED DESCRIPTION OF THE PREFERRED EMBODIMENT

Figure 1:
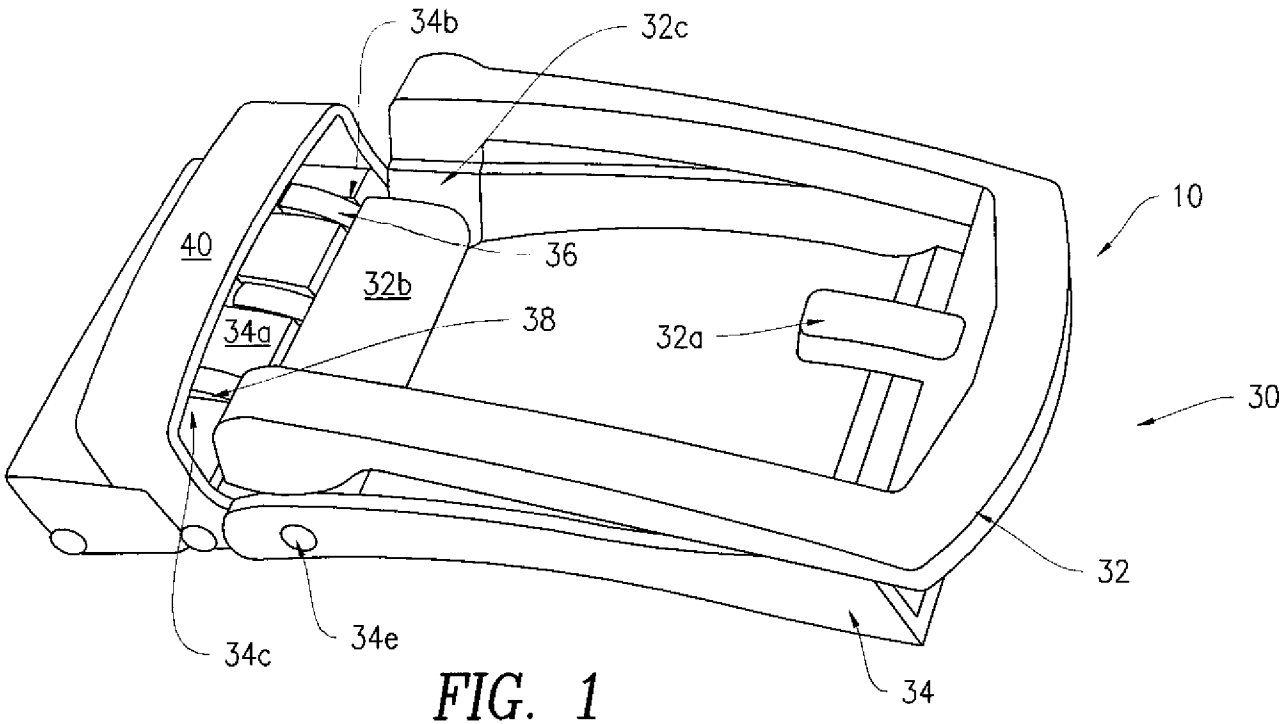
FIG. 1 is a top perspective view showing the buckle in the closed position.
Figure 2A:
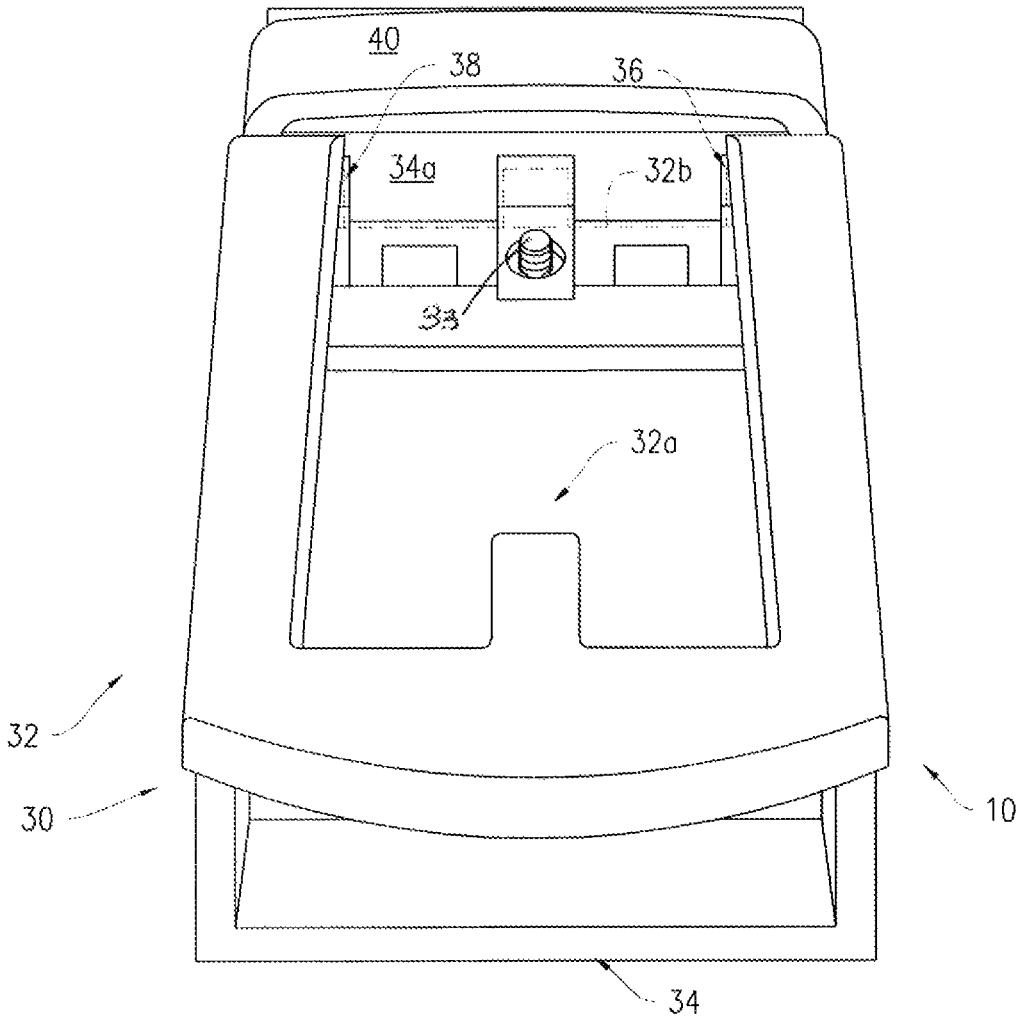
FIG. 2*a* is a top perspective view showing the showing the buckle and spring actuated teeth of the buckle in the closed position.
Figure 2B:
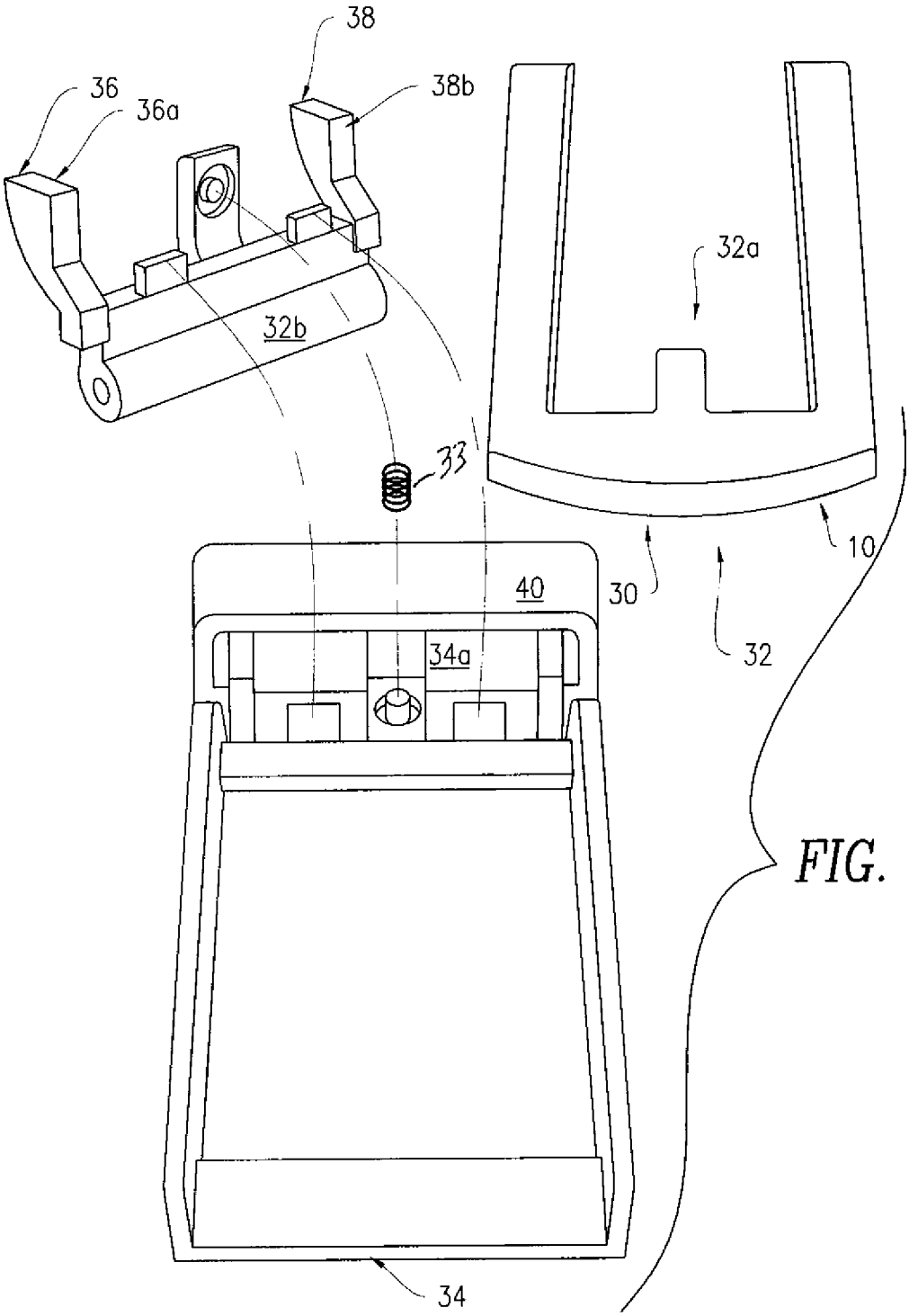
FIG. 2*b* is a first exploded view showing the upper buckle body, the lower buckle body, the spring actuated teeth of the buckle, and the buckle loop of the buckle.

As shown in FIGS. 3 through 9*f*, the present invention provides a reversible belt 10 that has a belt strap 12. The belt strap has top and bottom surfaces 14 and 16, with rows of notches 20 in the top surface 14 of the belt strap 12 and with notches 22 in the bottom surface 16 of the belt strap 12. As additionally shown in FIGS. 1 to 3*b*, and in FIGS. 4 through 9*f*, the belt 10 includes a buckle 30 having upper buckle body 32 and lower buckle body 34.

Thus, the reversible belt 10 is constructed to be freely reversible so that either the top surface 14 or bottom surface 16 of belt 12 may be visible when worn. This is accomplished by simply detaching the buckle 30 from the top surface 14 and reattaching it to bottom surface 16.

Figure 3A:
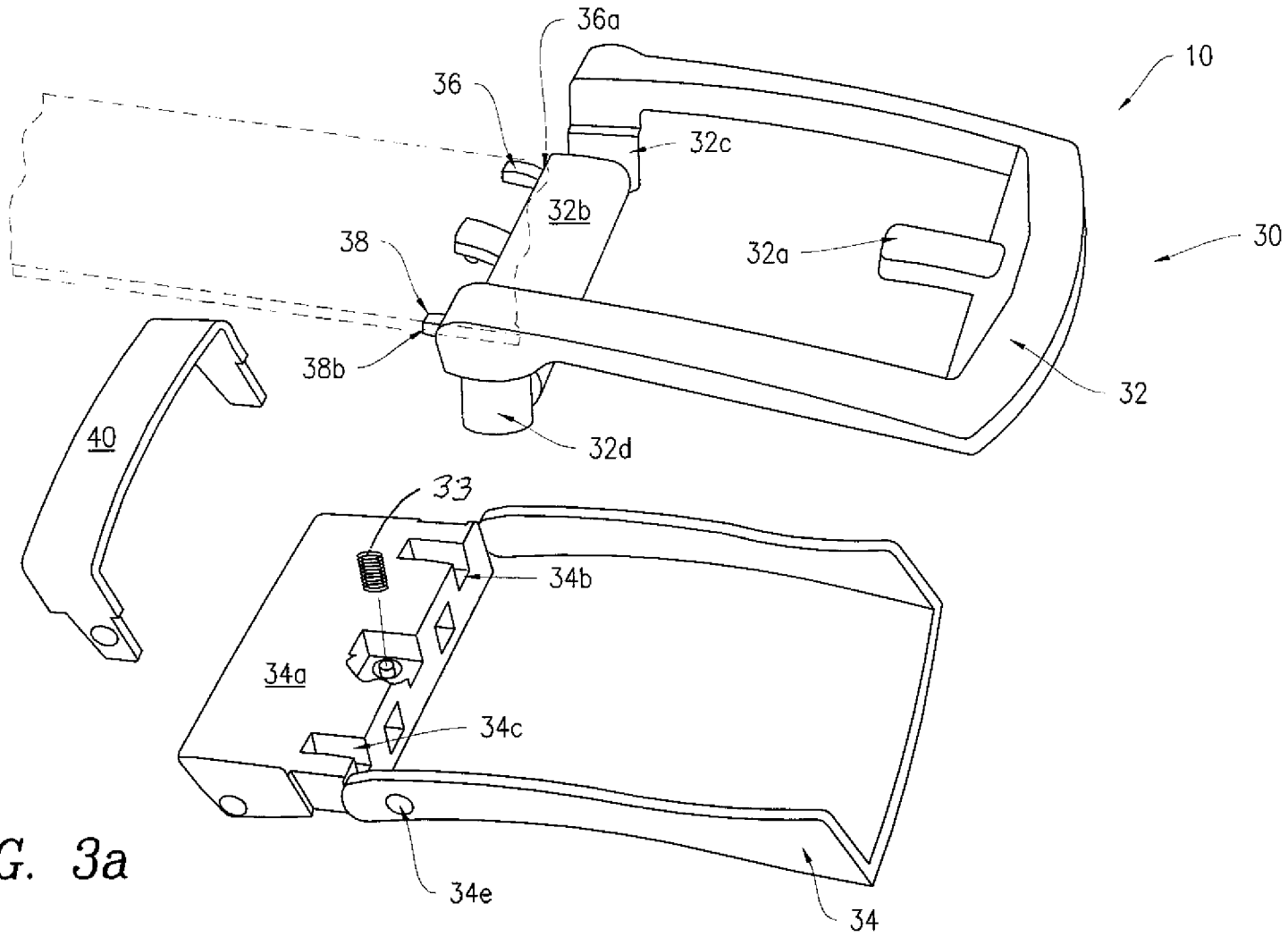
FIG. 3*a* is a second exploded view showing the upper buckle body, the lower buckle body, the spring actuated teeth of the buckle, and the buckle loop of the buckle.
Figure 3B:
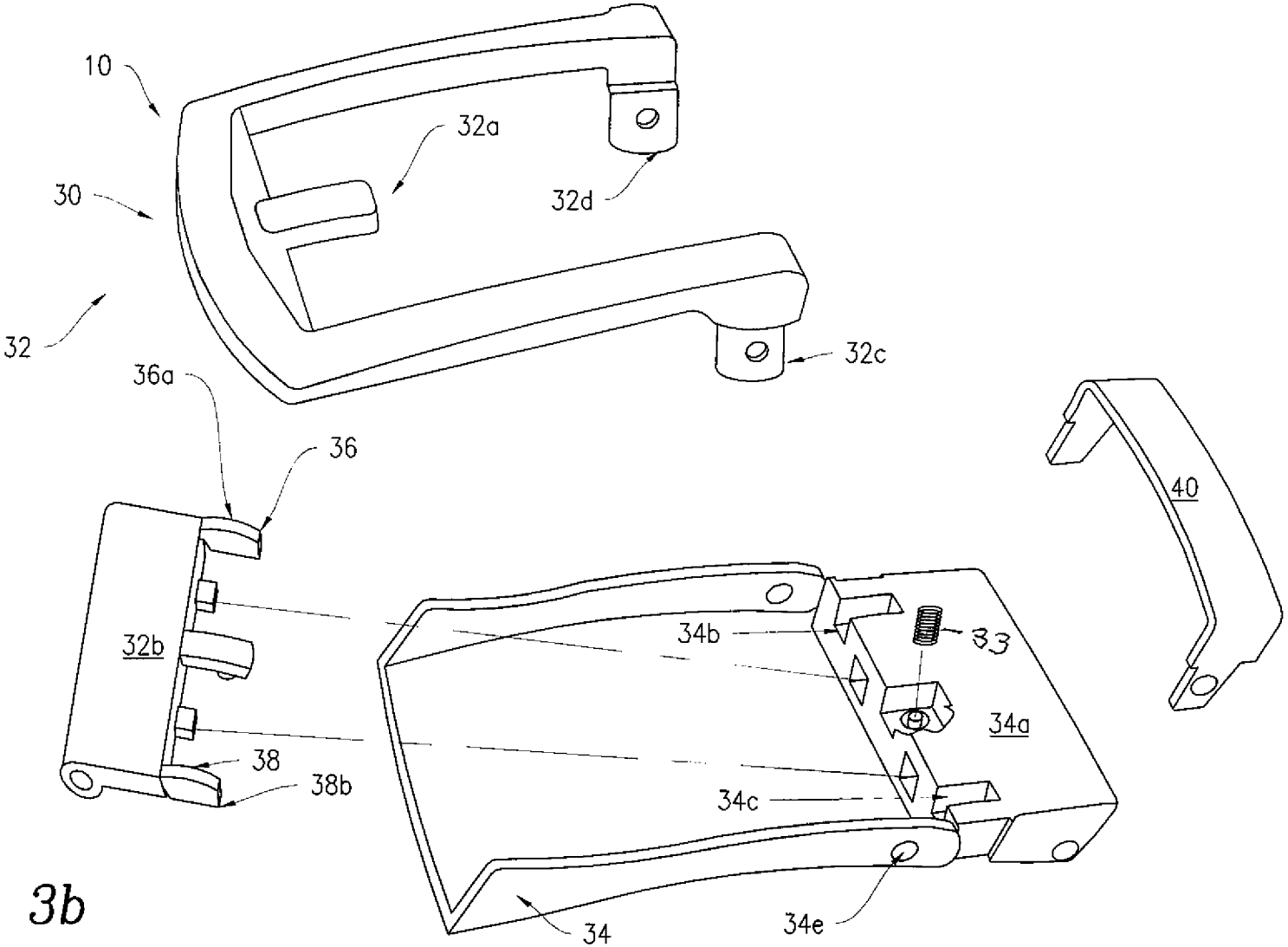
FIG. 3*b* is a second exploded view showing the upper buckle body, the lower buckle body, the spring actuated teeth of the buckle, and the buckle loop of the buckle.
Figure 4:
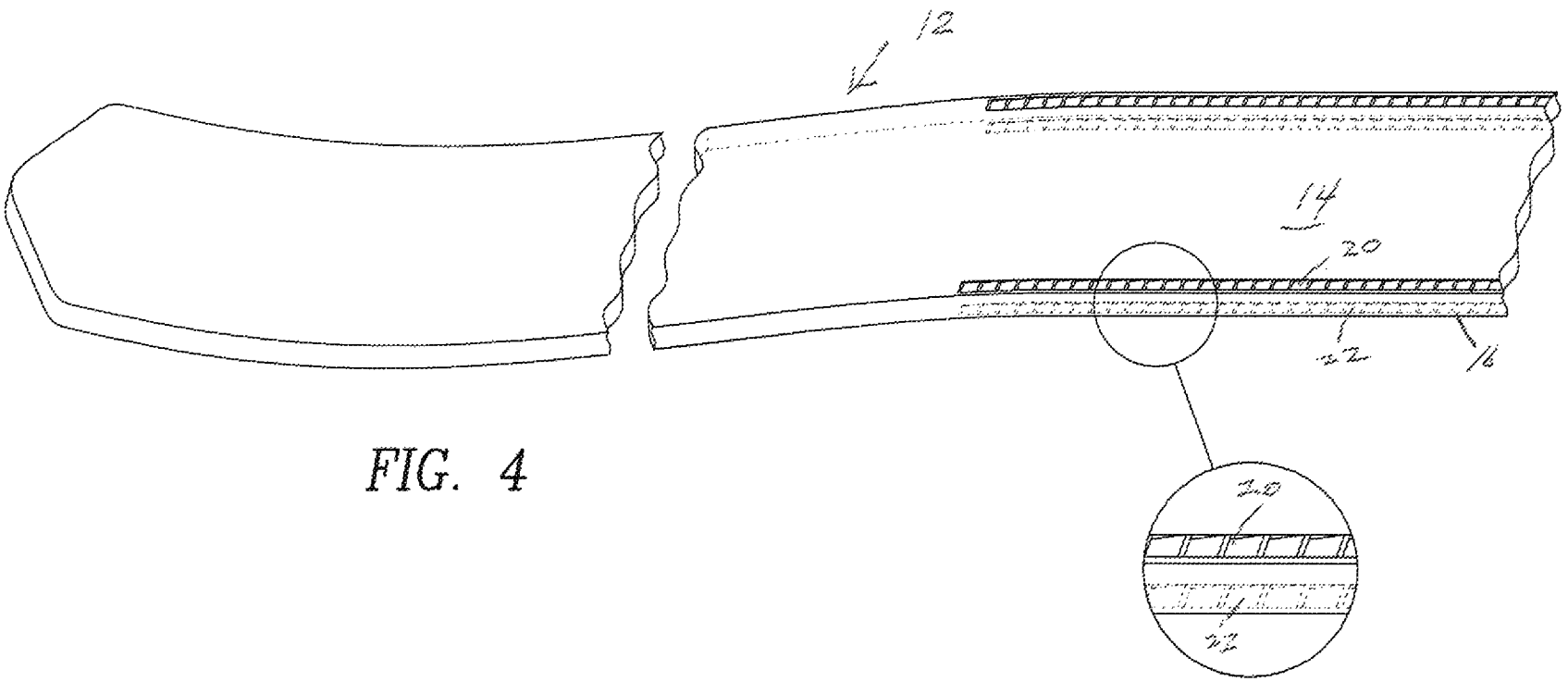
FIG. 4 is a side perspective view of the reversible belt strap showing the row of notches on the top and bottom surfaces of the belt strap.
Figure 5:
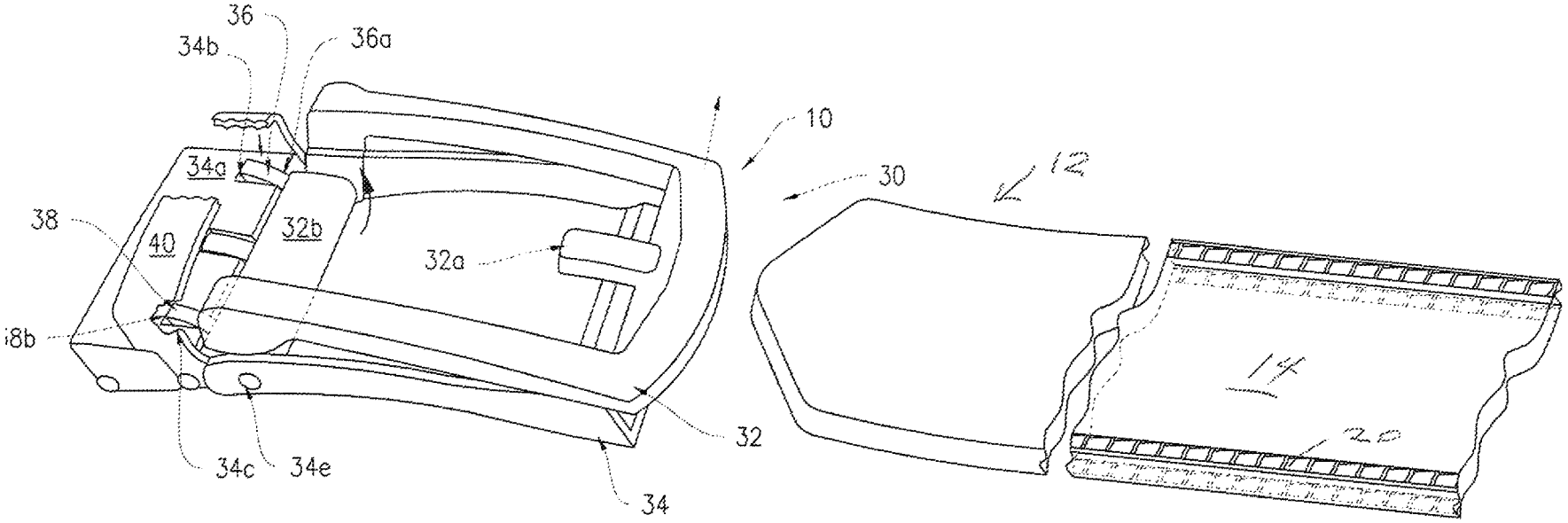
FIG. 5 is a side perspective view of the present invention showing the buckle in the closed position and showing the row of notches on the top and bottom surfaces of the belt strap.
Figure 6:
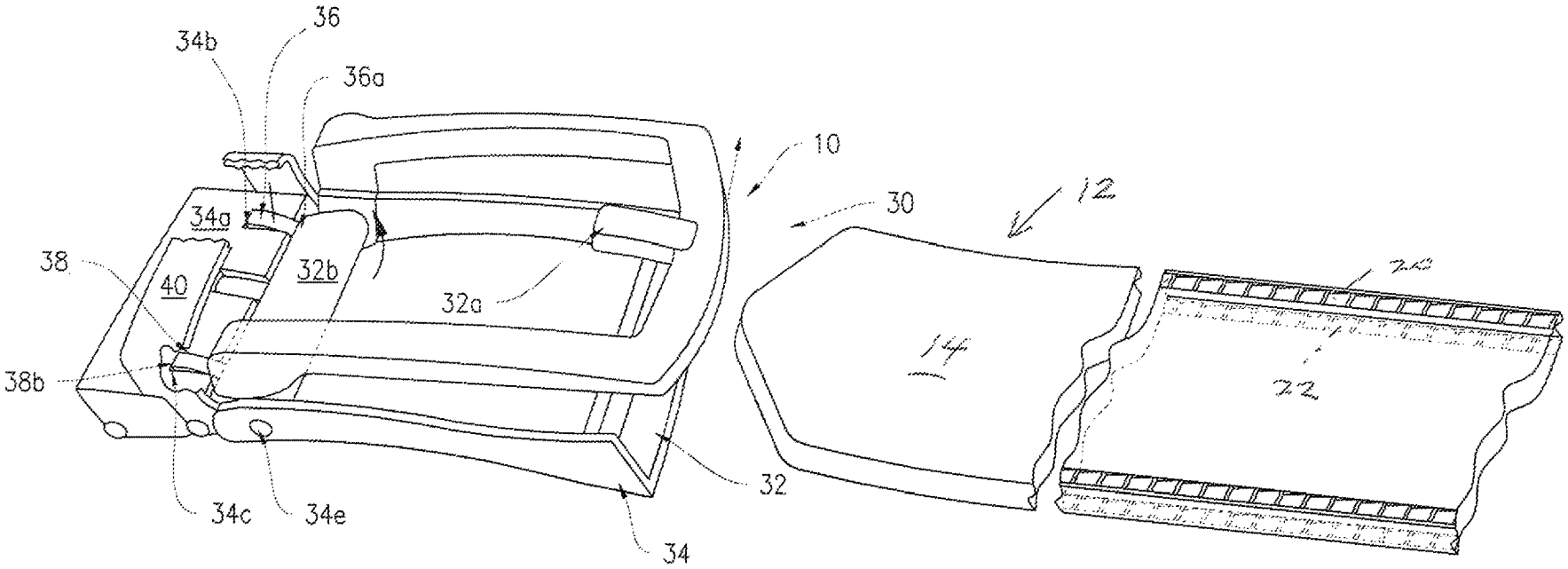
FIG. 6 is a side perspective view of the present invention showing the buckle in the partial open position and showing the row of notches on the top and bottom surfaces of the belt strap.
Figure 7:
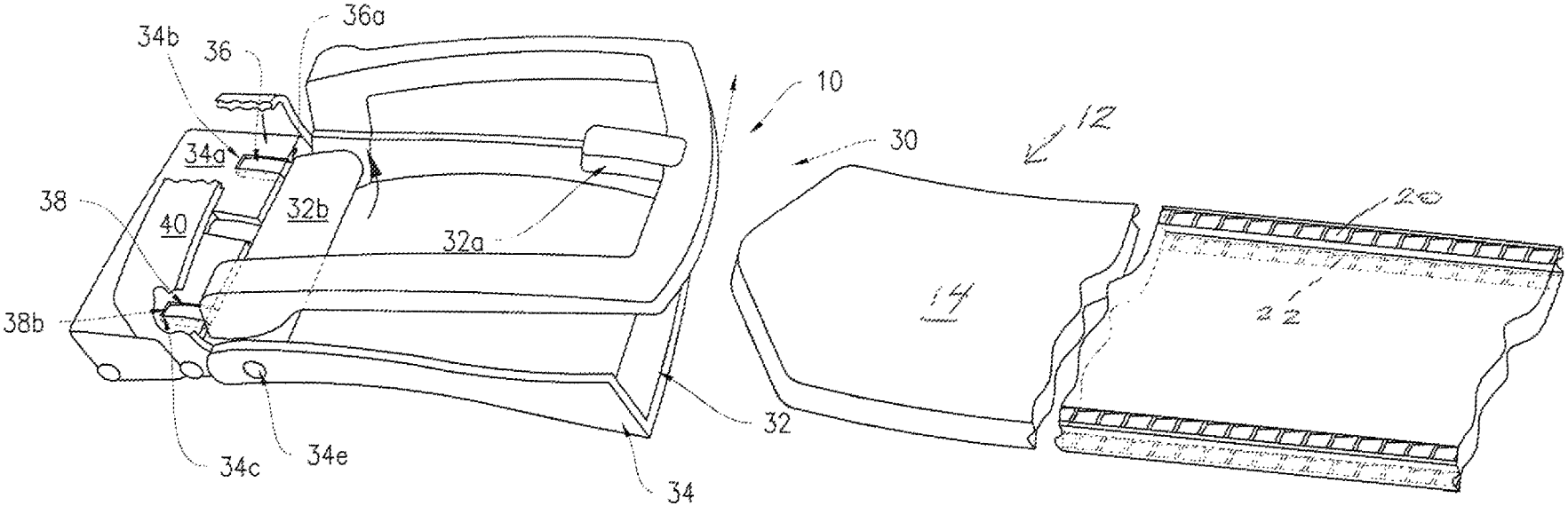
FIG. 7 is a side perspective view of the present invention showing the buckle in the open position and showing the row of notches on the top and bottom surfaces of the belt strap.
Figure 8A:
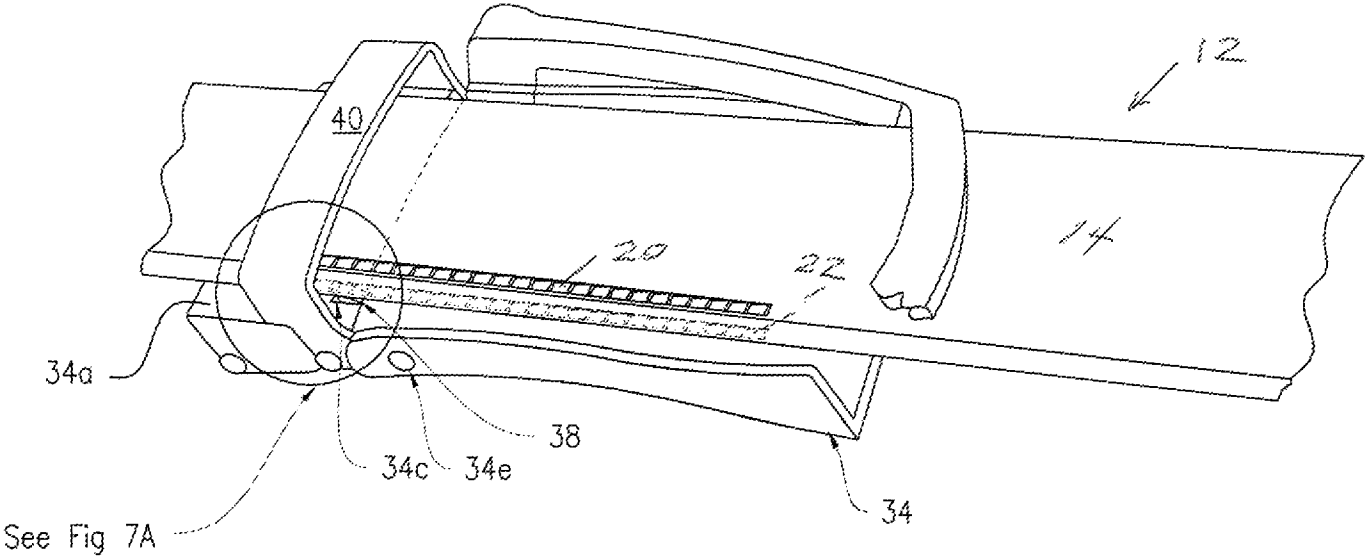
FIG. 8*a* is a partial side perspective view of the present invention showing the bottom tooth of the buckle engaging the notch on the bottom surface of the belt strap.
Figure 8B:
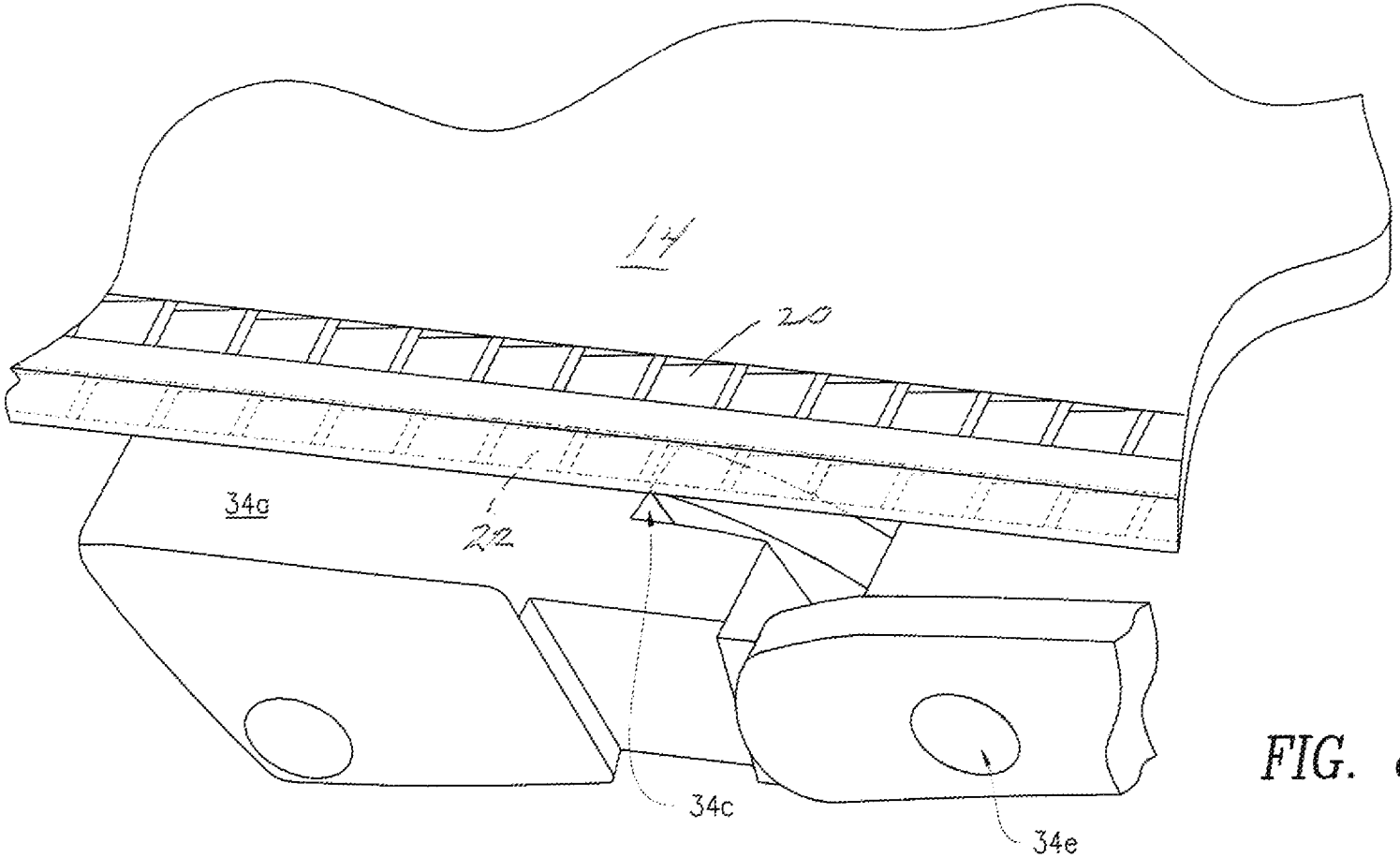
FIG. 8*b* is an enlarged partial side perspective view of the present invention showing the bottom tooth of the buckle engaging a notch on the bottom surface of the belt strap.
Figure 9B:
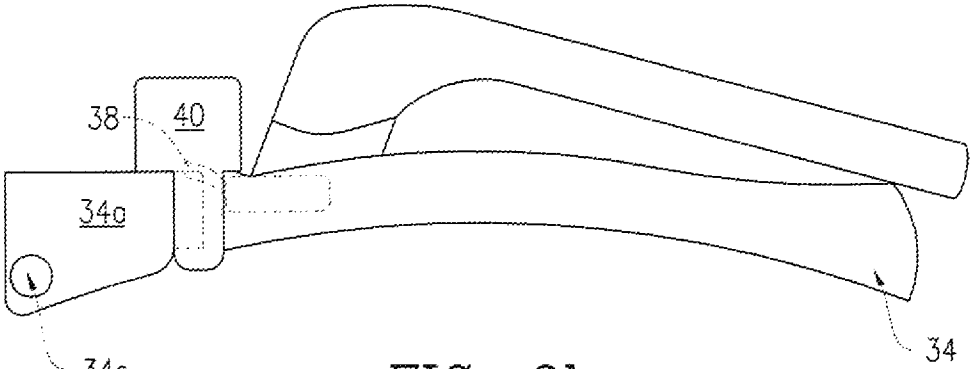
FIG. 9*b* is a side perspective view of the present invention showing the buckle and a spring actuated tooth of the buckle in the closed position.
Figure 9D:
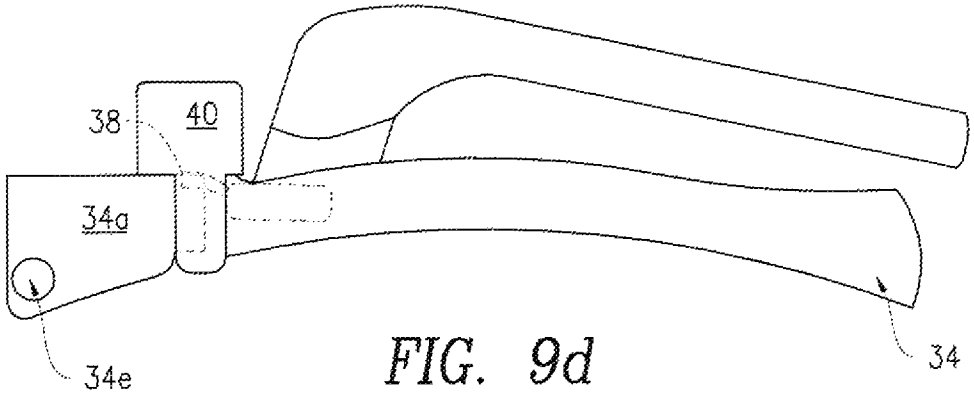
FIG. 9*d* is a side perspective view of the present invention showing the buckle and a spring actuated tooth of the buckle in a partial open position.
Figure 9A:
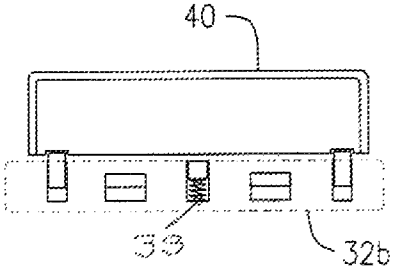
FIG. 9*a* is a partial cross sectional view of the present invention showing the spring actuated teeth of the buckle engaging two notches on the belt strap when the buckle is in the closed position.
Figure 9C:
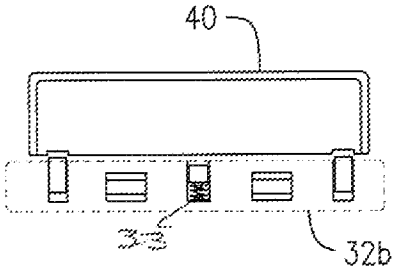
FIG. 9*c* is a partial cross sectional view of the present invention showing the spring actuated teeth of the buckle disengaging two notches on the belt strap when the buckle is in the partial open position.
Figure 9F:
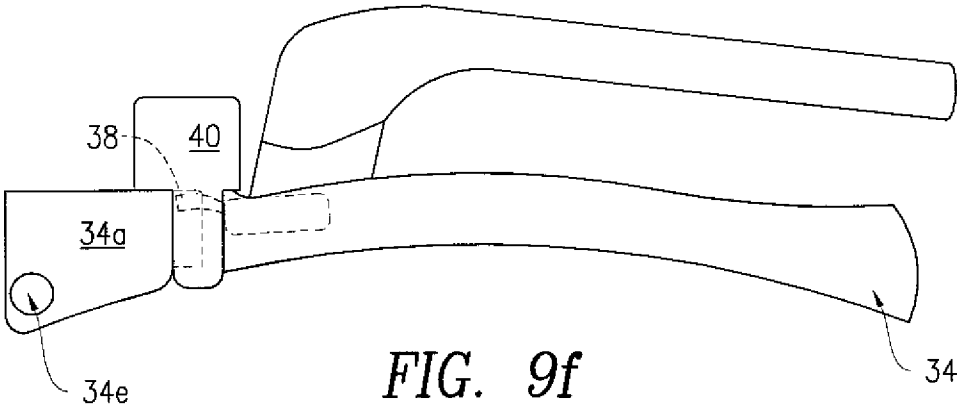
FIG. 9*f* is a side perspective view of the present invention showing the buckle and a spring actuated tooth of the buckle in the open position
Figure 9E:
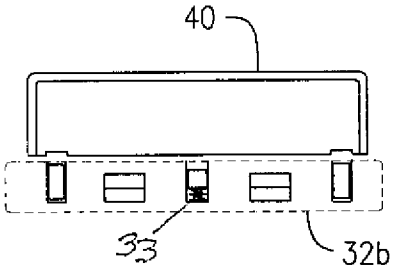
FIG. 9*e* is a partial cross sectional view of the present invention showing the spring actuated teeth of the buckle totally retracted and disengaged from the two notches on the belt strap when the buckle is in the open position.

As shown in FIGS. 1 through 3*b*, and 5 through 8*a*, upper buckle body 32 preferably in the shape of a u-shaped loop, optionally has a pin 32*a* in the middle of the loop at its distal end so as to penetrate one of the perforations of the corresponding extremity of the belt strap 12 while it is articulated relative to the transversal bar 32*b* at the proximal end of the upper buckle body 32. As shown in FIGS. 3*a* and 3*b*, the transversal bar 32*b* further includes transversal hinges 32*c* and 32*d* for hingedly attaching the upper buckle body 32 to the lower buckle body 34. In addition, the transversal body 32*b* has teeth 36 and 38 at each end for engaging either notches 20 in the top surface 14 of the belt strap 12 or notches 22 in the bottom surface 16 of the belt strap.

As shown in FIGS. 1 through 3*b*, and 5 through 8*a*, lower buckle body 34 is also preferably in the shape of a u-shaped loop. It has a base 34*a* at its proximal end with two tooth recesses 34*b* and 34*c* for receiving teeth 36 and 38 and a recess 34*f* for attaching actuating spring 33. Actuating spring 33 in recess 34*f* causes the teeth 36 and 38 to move up and down in a perpendicular direction. In this manner, the teeth 36 and 38 will selectively engage either notches 20 in the top surface 14 of the belt strap 12 or notches 22 in the bottom surface 16 of the belt strap.

In addition, the lower buckle body 34 has hinge pins 34*d* and 34*e* which hingedly engage the transversal hinges 32*c* and 32*d* of the upper buckle body 32 so as to hingedly attach the tipper buckle body 32 to the lower buckle body 34. This allows the upper buckle body 32 to be lifted relative to the lower buckle body 34. Furthermore, a buckle loop 40 is attached to the base 34*a* of the lower buckle body 34 for guiding and securing the extremity of the leather belt strap 12 after it passes through the buckle 30.

As shown in FIGS. 2*b* through 3*b* and 7*b*, each tooth 36 and 38 is attached to the transversal bar 32*b* of the upper buckle body 32 by tooth attachment posts 36*a* and 38*a*, respectively. Furthermore, as shown in FIGS. 2*b* through 3*b* and 7*b*, the bottom end of each tooth 36 and 38 also includes a tooth actuating post 36*b* and 38*b*, respectively. The tooth actuating posts 36*b* and 38*b* are the part of each tooth that is inserted in the tooth recesses 34*b* and 34*c* of the base 34*a* of the lower buckle body 34 and which engage with and are actuated in an up and down direction. Each tooth 36 and 38 further features a curved or inclined portion 36*c* and 38*c*. Curved portions 36*c* and 38*c* are shaped in such a fashion so as to easily slide in and out of, and thereby engage and disengage from either notches 20 in the top surface 14 of the belt strap 12 or notches 22 in the bottom surface 16 of the belt strap. Specifically, each individual notch of notches 20 and 22 has an angular shape or inclined shape in order to slide in or out of the notches to mateably engage with and disengage with the curved portions 36*c* and 38*c* of teeth 36 and 38.

In operation, and as shown in FIGS. 5 through 9*f*, the upper extremity of the belt strap 12 passes into and through the open end 50 of the buckle 30. The extremity of the belt strap 12 then passes over the transversal bar 32*b* and through the buckle loop 40 so that the teeth 36 and 38 of the transversal bar 32*b* then mateably engage the selected notches 20 on one side of the strap, or engage notches 22 when the strap is reversed. In order to loosen or tighten the belt strap 12 after it is locked in place, the user merely lifts the upper buckle body 32. Once the upper buckle body 32 is lifted it acts as a lever to cause the tooth actuating posts 36*b* and 38*b*, which results in teeth 36 and 38 being retracted from and disengage the selected notches. Once the user pulls the strap 12 through buckle 30 to achieve a desired "tightness" of the strap 12, the upper buckle body 32 is released and it returns to its downward closed position. This causes the actuating spring 33 to cause the teeth 36 and 38 to mateably engage the selected upper or lower notches 20 and 22 in the top or bottom surface of the belt strap 12. This process can be repeated until the desired "tightness" of the belt strap 12 is achieved.

In the specification the terms "comprise, comprises, comprised and comprising" or any variation thereof and the terms "include, includes, included and including" or any variation thereof are considered to be totally interchangeable and they should all be afforded the widest possible interpretation.

In addition, other modifications, alterations, and changes to the described embodiments are possible without departing from the scope of the claimed invention, as defined in the claims and their equivalents thereof. Thus, it is intended that the claimed invention not be limited by the described embodiments above, but that it be defined by the have the full scope of the following claims.

ADVANTAGES OF THE PRESENT INVENTION

It is an advantage of the present invention to provide a reversible belt strap that has notches on the surfaces of the strap to adjust the belt.

It is an advantage of the present invention to provide a buckle for adjustably engaging notches on the surfaces of the strap.

It is advantage of the present invention to provide a reversible belt having the above features.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A reversible track belt, comprising:

a) an elongated reversible strap (12) having a top surface (14) with spaced apart top edges, wherein each of said top edges has a row of top notches (20), and a bottom surface (16) with spaced apart bottom edges, wherein each of said bottom edges has a row of bottom notches (22), and wherein said top surface (14) and said bottom surface (16) are reversible in use; and b) a buckle having an upper buckle body (32) pivotally connected at one end to a lower buckle body (34) through a transversal bar (32*b*), wherein said transversal bar (32*b*) has a tooth (36, 38) at each end of the bar, wherein each of said teeth (36, 38) engages said top notches (20) on the top surface (14) of said strap (12), or engages said bottom notches (22) on the bottom surface (16) of said strap (12) when said belt strap is in the reversed position, wherein each of said teeth (36, 38) is attached to said transversal bar (32*b*) by a tooth attachment post (36*a*, 38*a*).

2. A reversible track belt in accordance with claim 1, wherein said lower buckle body receives therein said upper buckle body, and said upper buckle body and said lower buckle body are spaced apart at one end for receiving said reversible strap therein.

3. A reversible track belt in accordance with claim 1, wherein said upper buckle body has a u-shape.

4. A reversible track belt in accordance with claim 1, wherein said lower buckle body has a U-shape.

5. A reversible track belt in accordance with claim 1, wherein said top and bottom surfaces of said elongated strap are reversible.

6. A reversible track belt in accordance with claim 1, wherein said buckle is detachably attached to either the top surface or the bottom surface of said elongated strap.

* * * * *